US009826786B2

(12) United States Patent
Duffy

(10) Patent No.: US 9,826,786 B2
(45) **Date of Patent: *Nov. 28, 2017**

(54) HORIZONTAL FLAT-FOLD FILTERING FACE-PIECE RESPIRATOR HAVING INDICIA OF SYMMETRY

(71) Applicant: 3M INNOVATIVE PROPERTIES COMPANY, St. Paul, MN (US)

(72) Inventor: Dean R. Duffy, Woodbury, MN (US)

(73) Assignee: 3M Innovative Properties Company, St. Paul, MN (US)

( * ) Notice: Subject to any disclaimer, the term of this patent is extended or adjusted under 35 U.S.C. 154(b) by 63 days.

This patent is subject to a terminal disclaimer.

(21) Appl. No.: 14/510,177

(22) Filed: Oct. 9, 2014

(65) Prior Publication Data

US 2015/0020816 A1 Jan. 22, 2015

Related U.S. Application Data

(63) Continuation of application No. 12/562,253, filed on Sep. 18, 2009, now Pat. No. 8,881,729.

(51) Int. Cl.
*A41D 13/11* (2006.01)
*A62B 9/06* (2006.01)

(52) U.S. Cl.
CPC ..... *A41D 13/1115* (2013.01); *A41D 13/1161* (2013.01); *A62B 9/06* (2013.01)

(58) Field of Classification Search
CPC . A41D 13/1115; A41D 13/1161; A41D 13/11; A41D 13/1107; A41D 13/113; A41D 13/1123; A62B 9/06; A62B 18/02
See application file for complete search history.

(56) References Cited

U.S. PATENT DOCUMENTS

| | | | | |
|---|---|---|---|---|
| 3,603,315 | A | 9/1971 | Becker | |
| 3,971,369 | A * | 7/1976 | Aspelin | A41D 13/1115 128/206.19 |
| 3,971,373 | A | 7/1976 | Braun | |
| 4,013,816 | A | 3/1977 | Sabee et al. | |
| 4,215,682 | A | 8/1980 | Kubik et al. | |

(Continued)

FOREIGN PATENT DOCUMENTS

| | | |
|---|---|---|
| CA | 1296487 | 3/1992 |
| CN | 2609585 | 4/2004 |

(Continued)

OTHER PUBLICATIONS

U.S. Appl. No. 12/562,273, filed Sep. 18, 2009, Eitzman et al.

(Continued)

*Primary Examiner* — Steven Douglas
*Assistant Examiner* — Kathrynn Lyddane

(57) ABSTRACT

A horizontal flat-fold, filtering face-piece respirator 10 that includes a harness 14 and a mask body 12 that has a front surface, a first perimeter 24*a*, and a longitudinal axis 34. A nose clip 30 is secured to the mask body 12 centrally and adjacent to the first perimeter 24*a* of the mask body 12. An indicia 32 that is visible on the front surface of the mask body 12 in a vicinity of the nose clip 30 is provided to highlight a longitudinal axis of symmetry of the nose clip. The use of such an indicia, visible from the mask body front surface, enables a user to readily identify where the nose clip may be bent to prepare it for donning by the wearer.

13 Claims, 2 Drawing Sheets

(56) References Cited

U.S. PATENT DOCUMENTS

| | | | | |
|---|---|---|---|---|
| 4,312,338 | A | 1/1982 | Glassman | |
| RE31,285 | E | 6/1983 | Van Turnhout et al. | |
| 4,536,440 | A | 8/1985 | Berg | |
| 4,588,537 | A | 5/1986 | Klasse et al. | |
| 4,600,002 | A | 7/1986 | Maryyanek et al. | |
| D285,374 | S | 8/1986 | Huber et al. | |
| 4,606,341 | A | 8/1986 | Hubbard et al. | |
| 4,790,306 | A | 12/1988 | Braun et al. | |
| 4,798,850 | A | 1/1989 | Brown | |
| 4,807,619 | A | 2/1989 | Dyrud et al. | |
| 4,825,878 | A * | 5/1989 | Kuntz | A41D 13/11 128/207.11 |
| 4,850,347 | A | 7/1989 | Skov | |
| 5,237,986 | A | 8/1993 | Seppala et al. | |
| 5,307,796 | A | 5/1994 | Kronzer et al. | |
| 5,325,892 | A | 7/1994 | Japuntich et al. | |
| 5,496,507 | A | 3/1996 | Angadjivand et al. | |
| 5,558,089 | A * | 9/1996 | Castiglione | A41D 13/1146 128/203.29 |
| 5,617,849 | A | 4/1997 | Springett | |
| 5,656,368 | A | 8/1997 | Braun et al. | |
| 5,673,690 | A * | 10/1997 | Tayebi | A41D 13/1115 128/205.27 |
| 5,701,893 | A | 12/1997 | Kern et al. | |
| 5,706,803 | A | 1/1998 | Bayer | |
| 5,727,544 | A | 3/1998 | Miura | |
| 5,803,075 | A | 9/1998 | Yavitz | |
| 5,804,295 | A | 9/1998 | Braun et al. | |
| 5,813,423 | A | 9/1998 | Kirchgeorg | |
| 5,908,598 | A | 6/1999 | Rousseau et al. | |
| D412,573 | S | 8/1999 | Castiglione | |
| 5,934,275 | A | 8/1999 | Gazzara | |
| 6,041,782 | A | 3/2000 | Angadjivand et al. | |
| 6,062,221 | A | 5/2000 | Brostrom et al. | |
| 6,123,077 | A | 9/2000 | Bostock | |
| 6,234,171 | B1 | 5/2001 | Springett et al. | |
| 6,332,465 | B1 | 12/2001 | Xue et al. | |
| 6,336,459 | B1 | 1/2002 | Miyake | |
| 6,375,886 | B1 | 4/2002 | Angadjivand et al. | |
| 6,391,429 | B1 | 5/2002 | Senkus et al. | |
| 6,394,090 | B1 | 5/2002 | Chen et al. | |
| D458,364 | S | 6/2002 | Curran et al. | |
| 6,397,458 | B1 | 6/2002 | Jones et al. | |
| 6,398,847 | B1 | 6/2002 | Jones et al. | |
| 6,406,657 | B1 | 6/2002 | Eitzman et al. | |
| 6,409,806 | B1 | 6/2002 | Jones et al. | |
| 6,412,486 | B1 | 7/2002 | Glass | |
| 6,454,986 | B1 | 9/2002 | Eitzman et al. | |
| 6,484,722 | B2 | 11/2002 | Bostock et al. | |
| 6,492,286 | B1 | 12/2002 | Berrigan et al. | |
| RE37,974 | E | 2/2003 | Bowers | |
| 6,568,392 | B1 | 5/2003 | Bostock et al. | |
| 6,743,464 | B1 | 6/2004 | Insley et al. | |
| 6,783,574 | B1 | 8/2004 | Angadjivand et al. | |
| 6,824,718 | B2 | 11/2004 | Eitzman et al. | |
| 6,843,248 | B2 | 1/2005 | Japuntich et al. | |
| 6,854,463 | B2 | 2/2005 | Japuntich et al. | |
| 6,883,518 | B2 | 4/2005 | Mittelstadt et al. | |
| 6,886,563 | B2 | 5/2005 | Bostock et al. | |
| 6,923,182 | B2 | 8/2005 | Angadjivand | |
| 7,013,895 | B2 | 3/2006 | Martin et al. | |
| 7,028,689 | B2 | 4/2006 | Martin et al. | |
| 7,117,868 | B1 | 10/2006 | Japuntich et al. | |
| 7,131,442 | B1 | 11/2006 | Kronzer et al. | |
| RE39,493 | E | 2/2007 | Yuschak et al. | |
| 7,188,622 | B2 | 3/2007 | Martin et al. | |
| 7,311,104 | B2 | 12/2007 | Japuntich et al. | |
| 7,428,903 | B1 | 9/2008 | Japuntich et al. | |
| 8,881,729 | B2 | 11/2014 | Duffy | |
| 9,012,013 | B2 | 4/2015 | Duffy | |
| 2007/0068529 | A1 | 3/2007 | Kalatoor | |
| 2007/0175477 | A1 | 8/2007 | Baggett | |
| 2008/0271737 | A1 * | 11/2008 | Facer | A41D 13/11 128/205.25 |
| 2009/0090364 | A1 * | 4/2009 | Daugaard | A41D 13/11 128/206.19 |
| 2009/0205666 | A1 * | 8/2009 | Bowen | A41D 13/1107 128/206.13 |
| 2010/0154806 | A1 | 6/2010 | Duffy | |

FOREIGN PATENT DOCUMENTS

| | | | |
|---|---|---|---|
| CN | 101385577 | | 3/2009 |
| EP | 1 495 785 | A1 | 1/2005 |
| EP | 1757196 | | 2/2007 |
| GB | 2103491 | | 2/1983 |
| JP | 16-9899 | U | 7/1941 |
| JP | S58-027567 | A | 2/1983 |
| JP | S63-84253 | U | 6/1988 |
| JP | 3094413 | | 3/2006 |
| JP | 3121584 | | 5/2006 |
| JP | 2007021027 | A | 2/2007 |
| JP | 2007135801 | A | 6/2007 |
| JP | 2008279101 | A | 11/2008 |
| RU | 2068284 | | 10/1996 |
| RU | 2289460 | C2 | 12/2004 |
| WO | WO 96/28216 | A1 | 9/1996 |
| WO | WO 2007/038202 | | 4/2007 |

OTHER PUBLICATIONS

Davies, "The Separation of Airborne Dust Particles", 1952-1953, Institution of Mechanical Engineers Proceedings (B), The Institution of Mechanical Engineers, Westminster, London, United Kingdom, Nos. 1-12, vol. 1B, pp. 185-198.

Wente, "Superfine Thermoplastic Fibers", Aug. 1956, *Industrial and Engineering Chemistry*, 48(8):1342-1346.

* cited by examiner

HORIZONTAL FLAT-FOLD FILTERING FACE-PIECE RESPIRATOR HAVING INDICIA OF SYMMETRY

The present application is a continuation of U.S. patent application Ser. No. 12/562,253 filed Sep. 18, 2009 and herein incorporated by reference in its entirety.

The present invention pertains to a horizontal flat-fold filtering face-piece respirator that has an indicia, which conveys to the user an axis of symmetry for a bendable nose clip.

BACKGROUND

Respirators are commonly worn over the breathing passages of a person for at least one of two common purposes: (1) to prevent impurities or contaminants from entering the wearer's breathing track; and (2) to protect other persons or things from being exposed to pathogens and other contaminants exhaled by the wearer. In the first situation, the respirator is worn in an environment where the air contains particles that are harmful to the wearer, for example, in an auto body shop. In the second situation, the respirator is worn in an environment where there is risk of contamination to other persons or things, for example, in an operating room or a clean room.

A variety of respirators have been designed to meet either (or both) of these purposes. Some respirators have been categorized as being "filtering face-pieces" because the mask body itself functions as the filtering mechanism. Unlike respirators that use rubber or elastomeric mask bodies in conjunction with attachable filter cartridges (see, e.g., U.S. patent RE39,493 to Yuschak et al.) or insert-molded filter elements (see, e.g., U.S. Pat. No. 4,790,306 to Braun), filtering face-piece respirators are designed to have the filter media cover much of the whole mask body so that there is no need for installing or replacing a filter cartridge. Filtering face-piece respirators commonly come in one of two configurations: molded respirators and flat-fold respirators.

Molded filtering face-piece respirators have regularly comprised non-woven webs of thermally-bonded fibers or open-work plastic meshes to furnish the mask body with its cup-shaped configuration. Molded respirators tend to maintain the same shape during both use and storage. Examples of patents that disclose molded filtering face-piece respirators include U.S. Pat. No. 7,131,442 to Kronzer et al, U.S. Pat. Nos. 6,923,182, 6,041,782 to Angadjivand et al., U.S. Pat. No. 4,850,347 to Skov, U.S. Pat. No. 4,807,619 to Dyrud et al., U.S. Pat. No. 4,536,440 to Berg, and Des. 285,374 to Huber et al.

Flat-fold respirators—as their name implies—can be folded flat for shipping and storage. They also can be opened into a cup-shaped configuration for use.

Molded respirators have two general orientations when folded flat for storage. In one configuration—sometimes referred to as a "horizontal" flat-fold mask—the mask body is folded crosswise such that it has an upper portion and a lower portion. A second type of mask is referred to as a "vertical" flat-fold mask because the primary fold is oriented vertically when the mask viewed from the front in an upright position. Vertically-folded masks have left and right portions on opposing sides of the vertical fold.

Nose clips are commonly used on both horizontal and vertical flat-fold filtering face-piece respirators to achieve a snug fit over the wearer's nose. Conventional nose clips commonly take the form of malleable, dead soft, linear, strips of aluminum—see, for example, U.S. Pat. Nos. 5,558,089, 5,307,796, 4,600,002, 3,603,315; see also U.K. Patent Application GB 2,103,491 A. During use, nose clips typically are bent the most at the center—that is, over the bridge of the wearer's nose. Unlike horizontal masks, a vertical mask has the nose clip pre-folded into a symmetrical v-shape during storage. Therefore, when a vertical mask is opened before use, the nose clip is opened at the same time and helps place the mask into a symmetrical cup-shaped configuration for donning. This configuration makes the vertical mask easy to don and to adjust for proper fitting. In contrast, because a horizontal mask lies in a generally flat configuration on the mask body when in the storage condition, the vertical or longitudinal axis of symmetry is not readily identifiable. Unlike vertical masks, horizontal masks do not arrive from the factory folded about the longitudinal axis. Horizontal masks therefore lack an indication of symmetry, which allows the user to rapidly identify the centerline of the nose clip for bending purposes. Examples of horizontal flat-fold respirators are shown in U.S. Pat. Nos. 6,568,392 and 6,484,722 to Bostock et al. An example of a vertical flat-fold mask is shown in U.S. Pat. No. 6,394,090 to Chen.

Filtering face-piece respirators must be able to maintain a snug fit to the wearer's face to achieve either of the above-stated purposes for protecting the wearer and other persons or things from contamination. Known respirators can, for the most part, match the contour of a person's face over the cheeks and chin. In the nose region, however, there is a more drastic change in contour, which makes it more difficult to achieve a snug fit over that portion of the wearer's face. Failure to obtain a snug fit allows air to enter or exit the interior of the respirator without passing through the filter media. When inhaled and exhaled air is not filtered, contaminants may enter the wearer's respiratory system or others may be exposed to contaminants exhaled by the wearer. In addition, the wearer's eyeglasses can become fogged by exhaled air that escapes from the respirator interior over the nose region, making visibility more troublesome.

To properly conform a nose clip over the bridge of a wearer's nose, the wearer should be able to properly locate the centerline or line of symmetry of the nose clip. Desirably, the wearer would like to bend the nose clip at the center such that there are equal portions on each side of the wearer's nose when the mask is worn. Unless the respirator is a vertically folded mask, the respirator wearer may have difficulty locating the nose clip centerline before bending the nose clip. Some wearers may not properly identify the centerline of the nose clip and therefore may make an unsymmetrical bend prior to donning the mask. Although this non-symmetrical bend may later be corrected by the wearer after the mask body has been donned, the wearer must know to make this change. It would be beneficial to not have to make this correction in the first place.

SUMMARY OF THE INVENTION

The present invention provides a new horizontal flat-fold, filtering, face-piece respirator that comprises a harness, a mask body, a nose clip, and an indicia. The mask body is capable of being folded flat for storage and can be opened into a cup-shaped configuration for use. The mask body comprises a front surface, a first perimeter, and a longitudinal axis. The nose clip is secured to the mask body centrally and adjacent to the first perimeter of the mask body. The indicia is visible on the front surface of the mask body adjacent to the nose clip at the longitudinal axis of the mask body. The indicia can allow the wearer to identify the longitudinal axis of symmetry of the nose clip.

The present invention is beneficial in that it allows a wearer to pre-identify the point of symmetry on the mask body so that a pre-bend can be placed on the nose clip before placing the horizontal flat-fold mask over the wearer's nose. When the wearer knows where the centerline is located, the wearer can properly place a pre-bend in the nose clip before placing the mask on their face. The pre-bend allows for the mask to correctly rest on the wearer's nose when the straps are being drawn behind the wearer's head. Additional bends can then be placed in the nose clip to ensure that a snug fit is achieved over the wearer's nose and where the cheeks meet the nose. Using an indicia that identifies the nose clip centerline reduces the possibility that the wearer will improperly bend the nose clip or need to correct an improper bend.

GLOSSARY

The terms set forth below will have the meanings as defined:

"bisect(s)" means to divide into two generally equal parts;

"comprises (or comprising)" means its definition as is standard in patent terminology, being an open-ended term that is generally synonymous with "includes", "having", or "containing". Although "comprises", "includes", "having", and "containing" and variations thereof are commonly-used, open-ended terms, this invention also may be suitably described using narrower terms such as "consists essentially of", which is a semi open-ended term in that it excludes only those things or elements that would have a deleterious effect on the performance of the inventive respirator in serving its intended function;

"clean air" means a volume of atmospheric ambient air that has been filtered to remove contaminants;

"contaminants" means particles (including dusts, mists, and fumes) and/or other substances that generally may not be considered to be particles (e.g., organic vapors, et cetera) but which may be suspended in air;

"crosswise dimension" is the dimension that extends laterally across the respirator from side-to-side when the respirator is viewed from the front;

"cup-shaped configuration" means any vessel-type shape that is capable of adequately covering the nose and mouth of a person;

"exterior gas space" means the ambient atmospheric gas space into which exhaled gas enters after passing through and beyond the mask body and/or exhalation valve;

"filtering face-piece" means that the mask body itself is designed to filter air that passes through it; there are no separately identifiable filter cartridges or insert-molded filter elements attached to or molded into the mask body to achieve this purpose;

"filter" or "filtration layer" means one or more layers of air-permeable material, which layer(s) is adapted for the primary purpose of removing contaminants (such as particles) from an air stream that passes through it;

"filter media" means an air-permeable structure that is designed to remove contaminants from air that passes through it;

"filtering structure" means a construction that includes a filter media or a filtration layer and other layers as desired;

"first side" means an area of the mask body that is located on one side of a plane that bisects the mask body normal to the cross-wise dimension;

"harness" means a structure or combination of parts that assists in supporting the mask body on a wearer's face;

"horizontal flat-fold filtering face-piece respirator" means an air filtration device that is designed to be folded flat for storage without having a substantial fold about its longitudinal axis and that can be worn by a person to provide the wearer with clean air to breathe;

"indicia" means an identifying mark(s), pattern(s), image (s), opening(s), texture(s) or combination thereof;

"integral" means being manufactured together at the same time; that is, being made together as one part and not two separately manufactured parts that are subsequently joined together;

"interior gas space" means the space between a mask body and a person's face;

"laterally" means extending away from a plane that bisects the mask body normal to the cross-wise dimension when the mask body is in a folded condition;

"line of demarcation" means a fold, seam, weld line, bond line, stitch line, hinge line, and/or any combination thereof;

"longitudinal axis" means a line that bisects the mask body normal to the crosswise dimension;

"mask body" means an air-permeable structure that is designed to fit over the nose and mouth of a person and that helps define an interior gas space separated from an exterior gas space;

"nose clip" means a bendable mechanical device, which device is adapted for use on a mask body to assist in maintaining a desired mask body configuration at least around a wearer's nose;

"perimeter" means the outer edge of the mask body, which outer edge would be disposed generally proximate to a wearer's face when the respirator is being donned by a person;

"pleat" means a portion that is designed to be or is folded back upon itself;

"polymeric" and "plastic" each mean a material that mainly includes one or more polymers and that may contain other ingredients as well;

"plurality" means two or more;

"second side" means an area of the mask body that is located on one side of a plane that bisects the mask body normal to the cross-wise dimension (the second side being opposite the first side);

"snug fit" or "fit snugly" means that an essentially air-tight (or substantially leak-free) fit is provided (between the mask body and the wearer's face);

"tab" means a part that exhibits sufficient surface area for attachment of another component; and "transversely extending" means extending generally in the crosswise dimension.

DETAILED DESCRIPTION OF PREFERRED EMBODIMENTS

In practicing the present invention, a horizontal flat-fold, filtering face-piece respirator is provided that has a visual and/or mechanical feature (indicia) that allows the user to easily locate the centerline of the nose clip on an expandable face mask so the nose clip can be "pre-conformed" by the user into a general "v" or "u" shape before donning. This pre-bend in the nose clip helps hold the mask body in a three-dimension shape that makes donning of the mask easier and more symmetrically accurate. Another aspect of the invention is a feature on the nose clip or mask body that entices the flat-folded mask to be symmetrically opened. This feature could be, for instance, two plastic pieces that straddle the longitudinal axis 34 with a gap such that a "living hinge" is created—enticing the mask body 12 to open in a symmetrical fashion. Another possibility is that the nose clip has a notch, score, line, hole or other feature centrally located on the nose clip, such that it is weaker in this area. When the mask body is opened—the nose clip has a tendency to fold in this weakened area, which is centrally located on the nose clip, enticing the mask body to be symmetrically opened.

Figure 1:
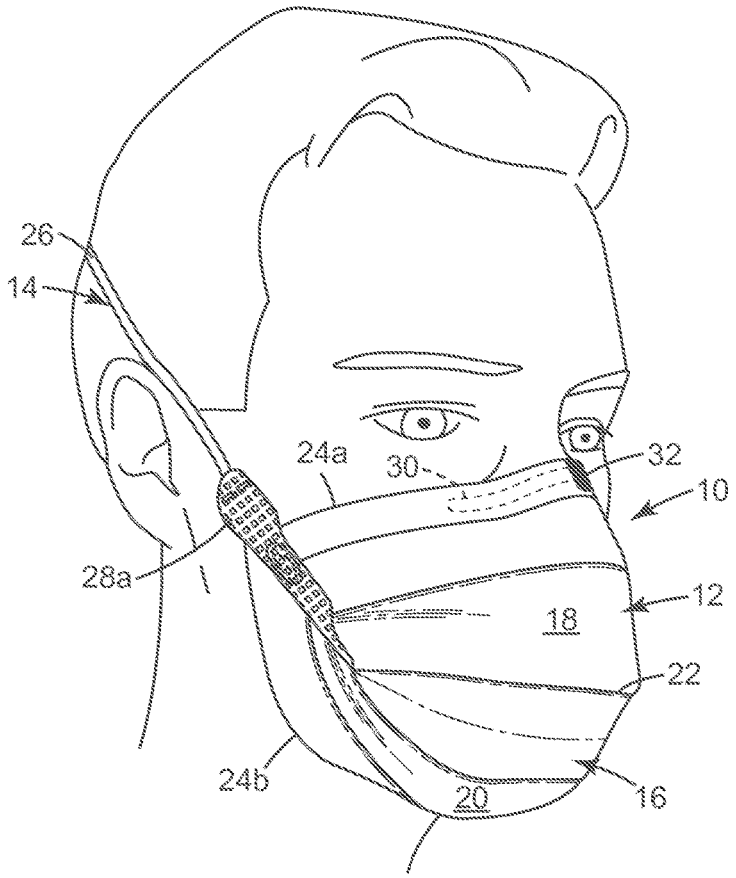
FIG. 1 is a front perspective view of a horizontal flat-fold filtering face-piece respirator 10, in accordance with the present invention, being worn on a person's face.

FIG. 1 shows an example of a horizontal flat-fold filtering face-piece respirator 10 in an opened condition on a wearer's face. The respirator 10 may be used in accordance with the present invention to provide clean air for the wearer to breathe. As illustrated, the filtering face-piece respirator 10 includes a mask body 12 and a harness 14. The mask body 12 has a filtering structure 16 through which inhaled air must pass before entering the wearer's respiratory system. The filtering structure 16 removes contaminants from the ambient environment so that the wearer can breathe clean air. The mask body 12 includes a top portion 18 and a bottom portion 20. The top portion 18 and the bottom portion 20 are separated by a line of demarcation 22. In this particular embodiment, the line of demarcation 22 may be a pleat or fold line that extends transversely across the central portion of the mask body. The mask body 12 also includes a perimeter that includes an upper segment 24*a* and a lower segment 24*b*. The harness 14 has a strap 26 that is stapled to a tab 28*a*. A nose clip 30 may be placed on the top portion 18 of the mask body on an outer surface or beneath a cover web adjacent to the upper segment 24*a*. An indicia 32 may be visible on the front surface of the mask body 12 adjacent to the nose clip 30.

Figure 2:
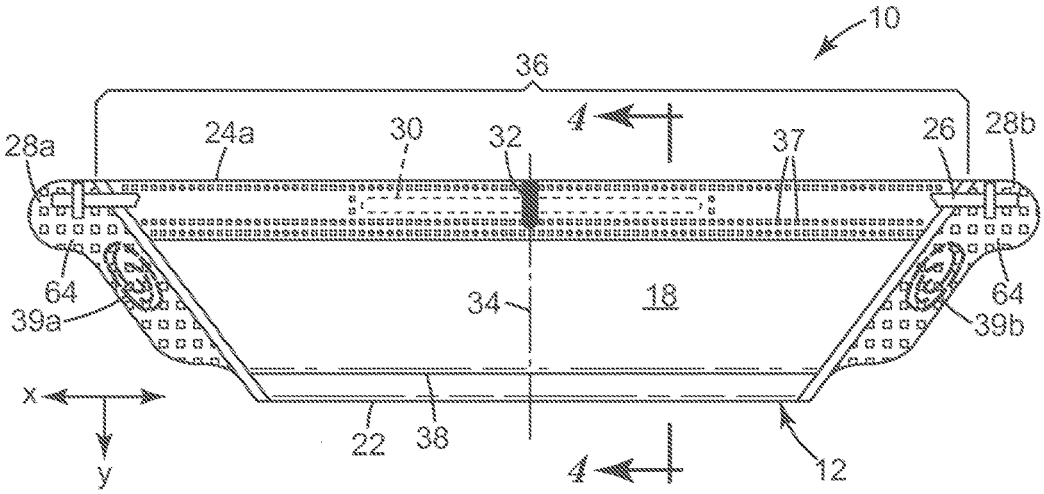
FIG. 2 is a top view of the respirator 10 of FIG. 1 in a horizontally folded condition.

FIG. 2 illustrates that the indicia 32 can be located at the longitudinal axis 34 of the mask body 12. The indicia may be a printed line that is about 1 to 4 millimeters (mm) wide and about 2 to 8 mm long. The face-contacting periphery of the mask body 12 generally resides within the bracketed area 36. The mask body perimeter may have a series of bonds or welds 37 to join the various layer of the mask body 12 together. The mask body 12 also may include a pleat line 38 that extends from a first side to a second side of the mask body, transversely. On each side of the mask body 12 are tabs 28*a*, 28*b* that provide a surface for grasping the mask body 12 during donning, adjusting, and doffing. An indicator 39*a*, 39*b*, resembling a fingerprint, can be provided on each tab to highlight where the user may grasp the mask body 12. The use of the grasping indicator is further described in U.S. patent application Ser. No. 12/562,273, entitled Filtering Face-Piece Respirator Having Grasping Feature Indicator, filed Sep. 18, 2009.

Figure 3:
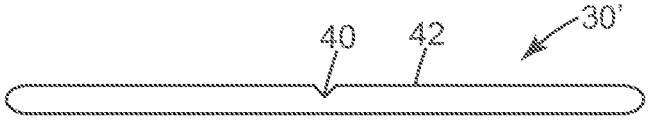
FIG. 3 is a top view of a nose clip 30' that may be used in connection with the present invention.

FIG. 3 illustrates an example of a nose clip 30' that may have the indicia as an integral part of the nose clip itself. The nose clip 30' has a small notch 40 cut into the first edge 42 of the nose clip 30'. As illustrated, the notch 40 resembles the shape of a "v". The notch, of course, could take on other configurations such as being u-shaped, rectangular-shaped, or hemispherical. For manufacturing purposes, each nose clip could have an indent notch and a corresponding outdent notch. Additionally, if the nose clip 30' has sufficient thickness, the center of the nose clip could be identified by a small circular opening stamped at the bisecting line of symmetry of the nose clip 30'. When the indicia is integral to the nose clip as illustrated in FIG. 3, the nose clip, preferably, is disposed on the outer most layer of the filtering structure 16. If the nose clip is capable of being viewed beneath a sufficiently thin outer layer of cover web, the nose clip could be placed beneath it as illustrated in, for example, FIGS. 1 and 4. In addition to a notch 40, a score line or other indicia could be placed on the nose clip.

Figure 4:
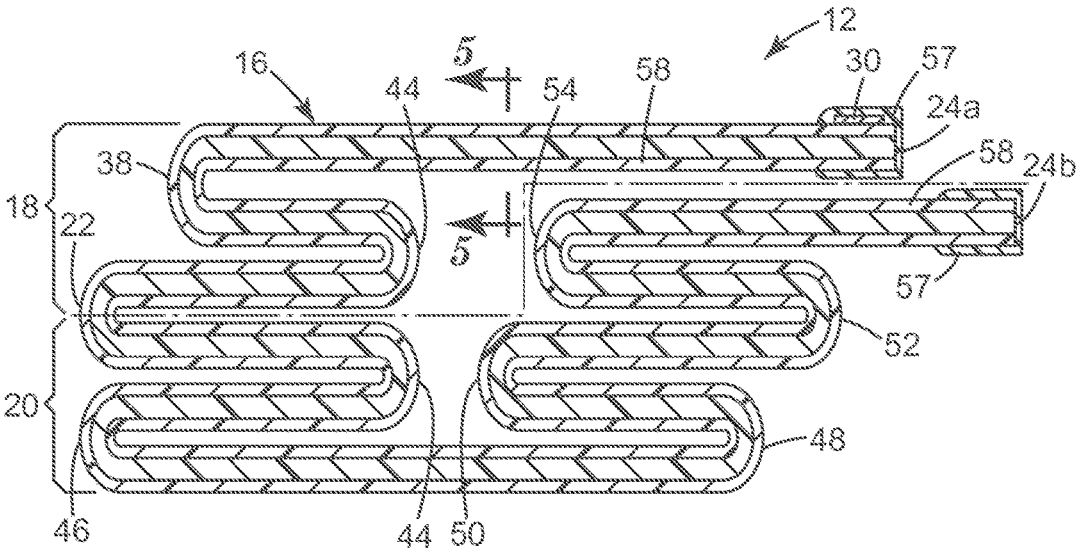
FIG. 4 is a cross-sectional view of the mask body 12 taken along lines 4-4 of FIG. 2.

FIG. 4 illustrates an example of a pleated configuration of a horizontal flat-fold mask body 12 that may be used in the present invention. As shown, the mask body 12 includes pleats 22 and 38, already described with reference to FIGS. 1 and 2. The upper portion or panel 18 of the mask body 12 also includes pleat 44. The lower portion or panel 20 of the mask body 12 includes pleats 46, 48, 50, 52, and 54. The lower portion 20 of the mask body 12 may include more filter media surface area than the upper portion 18. The mask body 12 also includes a perimeter web 57 that is secured to the mask body along its perimeter. The perimeter web 57 may be folded over the mask body at the perimeter 24*a*, 24*b*. The perimeter web 57 also may be an extension of an inner cover web 58 folded and secured around the edge of 24*a* and 24*b*. The nose clip 30 may be disposed on the upper portion 18 of the mask body centrally adjacent to the perimeter between the filtering structure 16 and the perimeter web 57. The nose clip 30 may be made from a pliable dead soft metal or plastic that is capable of being manually adapted by the wearer to fit the contour of the wearer's nose. The nose clip may be made from aluminum and may be linear as shown in FIGS. 2 and 3 or it may take on other shapes when viewed from the top such as the m-shaped nose clip shown in U.S. Pat. No. 5,558,089 and Des. 412,573 to Castiglione. A plastic nose clip is described in published U.S. Patent Application Publication 2007/0068529A1 to Kalatoor. As shown, the upper portion 18 appears as a pleated panel when the mask body 12 is in a folded condition; similarly the lower portion 20 (FIG. 1) appears as a pleated panel when the mask is in its folded storage condition.

Figure 5:
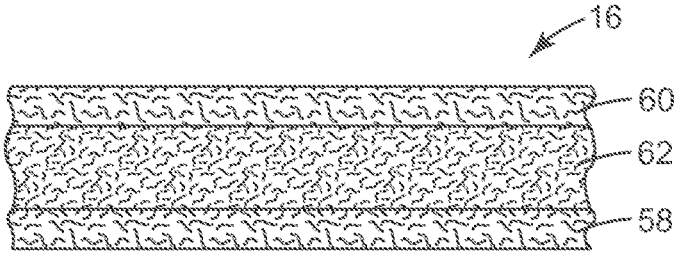
FIG. 5 is a cross-sectional view of the filtering structure 16 taken along lines 5-5 of FIG. 4.

FIG. 5 illustrates that the filtering structure 16 may include one or more layers of fibrous material, such as the inner cover web 58, an outer cover web 60, and a filtration layer 62. The inner and outer cover webs 58 and 60 may be provided to protect the filtration layer 62 and to preclude fibers from the filtration layer 62 from coming loose and entering the mask interior. During respirator use, air passes sequentially through layers 60, 62, and 58 before entering the mask interior. The air that is disposed within the interior gas space of the mask may then be inhaled by the wearer. When a wearer exhales, the air passes in the opposite direction sequentially through layers 58, 62, and 60. Alternatively, an exhalation valve (not shown) may be provided on the mask body to allow exhaled air to be rapidly purged from the interior gas space to enter the exterior gas space without passing through filtering structure 16. Typically, the cover webs 58 and 60 are made from a selection of nonwoven materials that provide a comfortable feel, particularly on the side of the filtering structure that makes contact with the wearer's face. The construction of various filter layers and cover webs that may be used in conjunction with the support structure of the present invention are described below in more detail. To improve wearer fit and comfort, an elastomeric face seal can be secured to the perimeter of the filtering structure 16. Such a face seal may extend radially inward to contact the wearer's face when the respirator is being donned. Examples of face seals are described in U.S. Pat. No. 6,568,392 to Bostock et al., U.S. Pat. No. 5,617,849 to Springett et al., and U.S. Pat. No. 4,600,002 to Maryyanek et al., and in Canadian Patent 1,296,487 to Yard. The filtering structure also may have a structural netting or mesh juxtaposed against at least one or more of the layers 58, 60, or 62, typically against the outer surface of the outer cover web 60. The use of such a mesh is described in U.S. Patent Publication 2010/0154806 A1 to Duffy.

The horizontal mask body that is used in connection with the present invention may take on a variety of different shapes and configurations. Generally the shape and configuration of the filtering structure corresponds to the general shape of the mask body. Although a filtering structure has been illustrated with multiple layers that include a filtration layer and two cover webs, the filtering structure may simply comprise a filtration layer or a combination of filtration layers. For example, a pre-filter may be disposed upstream to a more refined and selective downstream filtration layer. Additionally, sorptive materials such as activated carbon may be disposed between the fibers and/or various layers that comprise the filtering structure. Further, separate particulate filtration layers may be used in conjunction with sorptive layers to provide filtration for both particulates and vapors. The filtering structure may include one or more stiffening layers that assist in providing a cup-shaped configuration. The filtering structure also could have one or more horizontal and/or vertical lines of demarcation that contribute to its structural integrity. Using the first and second flanges in accordance with the present invention, however, may make unnecessary the need for such stiffening layers and lines of demarcation.

The filtering structure that is used in a mask body of the invention can be of a particle capture or gas and vapor type filter. The filtering structure also may be a barrier layer that prevents the transfer of liquid from one side of the filter layer to another to prevent, for instance, liquid aerosols or liquid splashes (e.g. blood) from penetrating the filter layer. Multiple layers of similar or dissimilar filter media may be used to construct the filtering structure of the invention as the application requires. Filters that may be beneficially employed in a layered mask body of the invention are generally low in pressure drop (for example, less than about 195 to 295 Pascals at a face velocity of 13.8 centimeters per second) to minimize the breathing work of the mask wearer. Filtration layers additionally are flexible and have sufficient shear strength so that they generally retain their structure under the expected use conditions. Examples of particle capture filters include one or more webs of fine inorganic fibers (such as fiberglass) or polymeric synthetic fibers. Synthetic fiber webs may include electret-charged polymeric microfibers that are produced from processes such as melt-blowing. Polyolefin microfibers formed from polypropylene that has been electrically charged provide particular utility for particulate capture applications. As alternate filter layer may comprise a sorbent component for removing hazardous or odorous gases from the breathing air. Sorbents may include powders or granules that are bound in a filter layer by adhesives, binders, or fibrous structures—see U.S. Pat. No. 6,234,171 to Springett et al. and U.S. Pat. No. 3,971,373 to Braun. A sorbent layer can be formed by coating a substrate, such as fibrous or reticulated foam, to form a thin coherent layer. Sorbent materials may include activated carbons that are chemically treated or not, porous alumna-silica catalyst substrates, and alumna particles. An example of a sorptive filtration structure that may be conformed into various configurations is described in U.S. Pat. No. 6,391,429 to Senkus et al.

The filtration layer is typically chosen to achieve a desired filtering effect. The filtration layer generally will remove a high percentage of particles and/or or other contaminants from the gaseous stream that passes through it. For fibrous filter layers, the fibers selected depend upon the kind of substance to be filtered and, typically, are chosen so that they do not become bonded together during the molding operation. As indicated, the filtration layer may come in a variety of shapes and forms and typically has a thickness of about 0.2 millimeters (mm) to 1 centimeter (cm), more typically about 0.3 mm to 0.5 cm, and it could be a generally planar web or it could be corrugated to provide an expanded surface area—see, for example, U.S. Pat. Nos. 5,804,295 and 5,656,368 to Braun et al. The filtration layer also may include multiple filtration layers joined together by an adhesive or any other means. Essentially any suitable material that is known (or later developed) for forming a filtering layer may be used as the filtering material. Webs of melt-blown fibers, such as those taught in Wente, Van A., *Superfine Thermoplastic Fibers,* 48 Indus. Engn. Chem., 1342 et seq. (1956), especially when in a persistent electrically charged (electret) form are especially useful (see, for example, U.S. Pat. No. 4,215,682 to Kubik et al.). These melt-blown fibers may be microfibers that have an effective fiber diameter less than about 20 micrometers (μm) (referred to as BMF for "blown microfiber"), typically about 1 to 12 μm. Effective fiber diameter may be determined according to Davies, C. N., *The Separation Of Airborne Dust Particles*, Institution Of Mechanical Engineers, London, Proceedings 1B, 1952. Particularly preferred are BMF webs that contain fibers formed from polypropylene, poly(4-methyl-1-pentene), and combinations thereof. Electrically charged fibrillated-film fibers as taught in van Turnhout, U.S. patent Re. 31,285, also may be suitable, as well as rosin-wool fibrous webs and webs of glass fibers or solution-blown, or electrostatically sprayed fibers, especially in microfilm form. Electric charge can be imparted to the fibers by contacting the fibers with water as disclosed in U.S. Pat. No. 6,824,718 to Eitzman et al., U.S. Pat. No. 6,783,574 to Angadjivand et al., U.S. Pat. No. 6,743,464 to Insley et al., U.S. Pat. Nos. 6,454,986 and 6,406,657 to Eitzman et al., and U.S. Pat. Nos. 6,375,886 and 5,496,507 to Angadjivand et al. Electric charge also may be imparted to the fibers by corona charging as disclosed in U.S. Pat. No. 4,588,537 to Klasse et al. or by tribocharging as disclosed in U.S. Pat. No. 4,798,850 to Brown. Also, additives can be included in the fibers to enhance the filtration performance of webs produced through the hydrocharging process (see U.S. Pat. No. 5,908,598 to Rousseau et al.). Fluorine atoms, in particular, can be disposed at the surface of the fibers in the filter layer to improve filtration performance in an oily mist environment—see U.S. Pat. Nos. 6,398,847 B1, 6,397,458 B1, and 6,409,806 B1 to Jones et al. Typical basis weights for electret BMF filtration layers are about 10 to 100 grams per square meter. When electrically charged according to techniques described in, for example, the '507 Angadjivand et al. patent, and when including fluorine atoms as mentioned in the Jones et al. patents, the basis weight may be about 20 to 40 $g/m^2$ and about 10 to 30 $g/m^2$, respectively.

An inner cover web can be used to provide a smooth surface for contacting the wearer's face, and an outer cover web can be used to entrap loose fibers in the mask body or for aesthetic reasons. The cover web typically does not provide any substantial filtering benefits to the filtering structure, although it can act as a pre-filter when disposed on the exterior (or upstream to) the filtration layer. To obtain a suitable degree of comfort, an inner cover web preferably has a comparatively low basis weight and is formed from comparatively fine fibers. More particularly, the cover web may be fashioned to have a basis weight of about 5 to 50 $g/m^2$ (typically 10 to 30 $g/m^2$), and the fibers may be less than 3.5 denier (typically less than 2 denier, and more typically less than 1 denier but greater than 0.1). Fibers used in the cover web often have an average fiber diameter of about 5 to 24 micrometers, typically of about 7 to 18 micrometers, and more typically of about 8 to 12 micrometers. The cover web material may have a degree of elasticity (typically, but not necessarily, 100 to 200% at break) and may be plastically deformable.

Suitable materials for the cover web may be blown microfiber (BMF) materials, particularly polyolefin BMF materials, for example polypropylene BMF materials (including polypropylene blends and also blends of polypropylene and polyethylene). A suitable process for producing BMF materials for a cover web is described in U.S. Pat. No. 4,013,816 to Sabee et al. The web may be formed by collecting the fibers on a smooth surface, typically a smooth-surfaced drum or a rotating collector—see U.S. Pat. No. 6,492,286 to Berrigan et al. Spun-bond fibers also may be used.

A typical cover web may be made from polypropylene or a polypropylene/polyolefin blend that contains 50 weight percent or more polypropylene. These materials have been found to offer high degrees of softness and comfort to the wearer and also, when the filter material is a polypropylene BMF material, to remain secured to the filter material without requiring an adhesive between the layers. Polyolefin materials that are suitable for use in a cover web may include, for example, a single polypropylene, blends of two polypropylenes, and blends of polypropylene and polyethylene, blends of polypropylene and poly(4-methyl-1-pentene), and/or blends of polypropylene and polybutylene. One example of a fiber for the cover web is a polypropylene BMF made from the polypropylene resin "Escorene 3505G" from Exxon Corporation, providing a basis weight of about 25 $g/m^2$ and having a fiber denier in the range 0.2 to 3.1 (with an average, measured over 100 fibers of about 0.8). Another suitable fiber is a polypropylene/polyethylene BMF (produced from a mixture comprising 85 percent of the resin "Escorene 3505G" and 15 percent of the ethylene/alpha-olefin copolymer "Exact 4023" also from Exxon Corporation) providing a basis weight of about 25 $g/m^2$ and having an average fiber denier of about 0.8. Suitable spunbond materials are available, under the trade designations "Corosoft Plus 20", "Corosoft Classic 20" and "Corovin PP-S-14", from Corovin GmbH of Peine, Germany, and a carded polypropylene/viscose material available, under the trade designation "370/15", from J. W. Suominen OY of Nakila, Finland.

Cover webs that are used in the invention preferably have very few fibers protruding from the web surface after processing and therefore have a smooth outer surface. Examples of cover webs that may be used in the present invention are disclosed, for example, in U.S. Pat. No. 6,041,782 to Angadjivand, U.S. Pat. No. 6,123,077 to Bostock et al., and WO 96/28216A to Bostock et al.

The strap(s) that are used in the harness may be made from a variety of materials, such as thermoset rubbers, thermoplastic elastomers, braided or knitted yarn/rubber combinations, inelastic braided components, and the like. The strap(s) may be made from an elastic material such as an elastic braided material. The strap preferably can be expanded to greater than twice its total length and be returned to its relaxed state. The strap also could possibly be increased to three or four times its relaxed state length and can be returned to its original condition without any damage thereto when the tensile forces are removed. The elastic limit thus is preferably not less than two, three, or four times the length of the strap when in its relaxed state. Typically, the strap(s) are about 20 to 30 cm long, 3 to 10 mm wide, and about 0.9 to 1.5 mm thick. The strap(s) may extend from the first tab to the second tab as a continuous strap or the strap may have a plurality of parts, which can be joined together by further fasteners or buckles. For example, the strap may have first and second parts that are joined together by a fastener that can be quickly uncoupled by the wearer when removing the mask body from the face. An example of a strap that may be used in connection with the present invention is shown in U.S. Pat. No. 6,332,465 to Xue et al. Examples of fastening or clasping mechanism that may be used to joint one or more parts of the strap together is shown, for example, in the following U.S. Pat. No. 6,062,221 to Brostrom et al., U.S. Pat. No. 5,237,986 to Seppala, and EP1,495,785A1 to Chien.

As indicated, an exhalation valve may be attached to the mask body to facilitate purging exhaled air from the interior gas space. The use of an exhalation valve may improve wearer comfort by rapidly removing the warm moist exhaled air from the mask interior. See, for example, U.S. Pat. Nos. 7,188,622, 7,028,689, and 7,013,895 to Martin et al.; U.S. Pat. Nos. 7,428,903, 7,311,104, 7,117,868, 6,854,463, 6,843,248, and 5,325,892 to Japuntich et al.; U.S. Pat. No. 6,883,518 to Mittelstadt et al.; and U.S. patent RE37,974 to Bowers. Essentially any exhalation valve that provides a suitable pressure drop and that can be properly secured to the mask body may be used in connection with the present invention to rapidly deliver exhaled air from the interior gas space to the exterior gas space.

This invention may take on various modifications and alterations without departing from its spirit and scope. Accordingly, this invention is not limited to the above-described but is to be controlled by the limitations set forth in the following claims and any equivalents thereof.

This invention also may be suitably practiced in the absence of any element not specifically disclosed herein.

All patents and patent applications cited above, including those in the Background section, are incorporated by reference into this document in total. To the extent there is a conflict or discrepancy between the disclosure in such incorporated document and the above specification, the above specification will control.

What is claimed is:

1. A horizontal flat-fold, filtering face-piece respirator that comprises:

a harness;

a mask body that has a front surface, a first perimeter, a series of bonds or welds located along the first perimeter, and a longitudinal axis;

a nose clip that is secured to the mask body centrally and adjacent the first perimeter of the mask body; and an indicia that is distinguishable from the series of bonds or welds and that is visible on the front surface of the mask body adjacent the first perimeter and the nose clip at the longitudinal axis of the mask body, wherein the indicia is printed on an outer surface of the mask body, wherein the indicia comprises a printed line located at the longitudinal axis of the mask body, and further wherein the indicia indicates a longitudinal axis of symmetry of the nose clip.

2. The respirator of claim 1, wherein the indicia is printed on a cover web under which the nose clip is located.

3. The respirator of claim 1, wherein the printed line is about 1 to 4 mm wide and 2 to 8 mm long.

4. The respirator of claim 1, wherein the mask body comprises a filter media and one or more cover webs, at least one of the cover webs residing over the nose clip but still allowing the nose clip to be visible thereunder.

5. The respirator of claim 1, further comprising indicia integral to the nose clip.

6. The respirator of claim 1, wherein the nose clip is linear when the respirator is in a horizontally folded condition.

7. A horizontal flat-fold, filtering face-piece respirator that comprises:

a harness;

a mask body that has a front surface, a first perimeter, a series of bonds or welds located along the first perimeter, and a longitudinal axis;

a nose clip that is secured to the mask body centrally and adjacent the first perimeter of the mask body; and an indicia that is distinguishable from the series of bonds or welds and that is visible on the front surface of the mask body adjacent the first perimeter at the longitudinal axis of the mask body, wherein the indicia is integral to the nose clip, wherein the indicia comprises a weakened area comprising at least one of a notch, a score line, and a small circular opening in the nose clip.

8. The respirator of claim 7, wherein the nose clip is disposed on an outer most layer of a filtering structure of the mask body.

9. The respirator of claim 7, wherein the mask body comprises a filtering structure comprising an inner cover web, an outer cover web, and a filtration layer between the inner and outer cover webs, wherein the nose clip is disposed between the outer cover web and the filtration layer.

10. The respirator of claim 7, wherein the indicia comprises the notch in the nose clip and printed indicia on the nose clip.

11. The respirator of claim 7, wherein the indicia comprises a v-shaped notch.

12. The respirator of claim 7, wherein the indicia comprises the notch and the score line.

13. The respirator of claim 7, wherein the nose clip is linear when the respirator is in a horizontally folded condition.

* * * * *